United States Patent [19]

Goozner

[11] 4,415,215

[45] Nov. 15, 1983

[54] SOLDERLESS ELECTRICAL SPLICE

[76] Inventor: Calman Goozner, 415 Barlow Ave., Staten Island, N.Y. 10308

[21] Appl. No.: 276,883

[22] Filed: Jun. 24, 1981

[51] Int. Cl.[3] ..... H01R 9/08

[52] U.S. Cl. ..... 339/98

[58] Field of Search ..... 339/98, 99, 96, 97 R, 339/97 P

[56] References Cited

U.S. PATENT DOCUMENTS

| | | | |
|---|---|---|---|
| 3,745,228 | 7/1973 | Vogt | 339/98 X |
| 3,766,514 | 10/1973 | Kimm | 339/99 R |
| 3,877,774 | 4/1975 | Dorrell | 339/99 R |
| 4,062,615 | 12/1977 | Navarro | 339/98 |
| 4,354,719 | 10/1982 | Weidler | 339/99 R X |

*Primary Examiner*—E. R. Kazenske
*Assistant Examiner*—John S. Brown
*Attorney, Agent, or Firm*—Kevin Redmond

[57] ABSTRACT

A device for providing a rapid, secure and insulated electrical splice by solderless means, comprising a body having a channel exposed along the upper surface of the body. The ends of the channel being connected to a first and a second opening on the ends of the body to accept the wires to be spliced. A substantially flat, conductive interconnection bar is positioned in the upper portion of the channel. Conductive prongs, projecting downward from the lower side of the interconnection bar, pierce the insulation of the wires to make the splice. An inverted "V" shaped cut in the prongs permit accepting a variety of wire sizes.

4 Claims, 16 Drawing Figures

SOLDERLESS ELECTRICAL SPLICE

1. Field

The present invention pertains to solderless electrical splices and, more particularly, to such splices designed to provide a low profile, in-line configuration which can be rapidly and safely applied by relatively inexperienced personnel.

2. Prior Art

A wide variety of prior art solderless electrical connectors are available, as illustrated by U.S. Pat. Nos. 2,802,083, 3,858,157, 4,013,332, 4,062,615 and 4,070,082, but none provide a low profile, in-line splice.

The term "in-line splice" as used herein is intended to represent a splice in which the leads are inserted in opposite ends of the splicing device and the splicing device has a longitudinal axis which generally runs in the direction of the entering wires. The term "low profile" as used herein refers to a splicing device which has a relatively small cross section in a plane transverse to the direction of the wires.

The advantage of a low profile, in-line splice is it may be placed in areas where there is not much room for more than the wires alone. The low profile, in-line splice also has an advantage in providing a neat, unobtrusive appearance in exposed wiring.

The prior art patents will be examined to determine the extent to which they exhibit these desirable features. U.S. Pat. No. 2,802,083 describes a circuit interrupt device in which a wire passing through the device is cut and a connection is made to both ends by means of two projections that are driven into the wire by a cam. Unfortunately, this is a bulky, complicated and expensive device not intended for in-line splices and is incapable of splicing various sizes of solid wires.

U.S. Pat. No. 3,858,157 describes a solderless tap connector which includes a grooved body to accept wires, and a slotted metal element designed to be forced into the wires to make contact. The leads in this device are not laid end to end for an in-line splice. A plate with a fixed slot width is used to make the contact, restricting this device to essentially one wire size. The cover is closed along a longitudinal seam and may be unlatched accidentally, subjecting personnel to shock or other injury.

U.S. Pat. No. 4,013,332 describes a solderless electrical connector in that a connector member is forced down over wires, which, in the process, are bent about the edges of the connector member. Although a number of wire sizes may be accommodated, they each must be placed in a hole especially adapted for the particular wire size and once inserted, all such wires are shorted together by the connector member. This design, which includes a block shaped insulator with a plurality of holes on one side, is not adapted for use as a low profile, in-line connector. In addition, the device has no insulation to cover the connector member, exposing personnal to possible shock or other injury.

U.S. Pat. No. 4,062,615 is a solderless splice which includes an insulating block and fixed mounted cutting surfaces used for cutting the insulation of wires. A cover, which carries the wires, is forced downward to engage the cutting surfaces. Unfortunately, the cover is connected to the body along one side, restricting motion to rotational about the side to which it is joined, thereby preventing a direct linear engagement of the wires with the cutting surfaces. There is no provision in this device to retain the wires in the cover during the rotational motion. In addition, there is no provision to lock the cover in place once closed, permitting the cover to be easily opened and thereby expose personnel to shock or other injury.

U.S. Pat. No. 4,070,082 includes a block into which a wedge is driven against flat wires which are to be spliced. The wires are placed on opposite sides of the wedge, making a low profile, in-line splice impossible. The device is limited to use with flat wires because it contains grooves in its side walls into which conventional wires with circular cross sections could fall without ever making electrical contact with the block.

Although these prior art devices may be satisfactory for particular application, not one lends itself to the formation of a low profile, in-line splice which may be simply and safely installed on wires of various size. The body of many of these prior art devices is often block shaped and the leads are inserted in one side only, or on diagonally opposite sides, making an in-line splice impossible.

In most of these prior art devices, the electrical connection is exposed or the cover can be easily opened, creating a safety hazard. In addition, the cutting edges are rigidly mounted to the body, or the cutting edges are guided into place by openings in the body, making connection difficult because of a lack of maneuverability. Finally, none of the prior art devices are designed to accept a wide variety of wire sizes in the same opening in the body, a necessity for a low profile, in-line splice.

SUMMARY

An object of the present invention is to provide a rapid, secure and insulated electrical splice.

An object of the present invention is to provide an electrical splice which can be installed safely by relatively inexperienced personnel.

An object of the present invention is to provide an electrical splice having an insulated, self-locking cover.

An object of the present invention is to provide a low profile, in-line splice.

An object of the present invention is to provide an electrical splice capable of accepting a wide range of wire sizes through a single pair of openings.

The present invention is a device for providing a rapid, secure and insulated electrical splice of the type in which a first and a second wire are electrically connected by solderless means. This device comprises a body of insulating material which may be described with reference to a longitudinal axis through the body and with respect to a horizontally positioned upper surface of the body. The body includes at least one channel which passes through the body in a direction parallel to the longitudinal axis and is exposed along the upper surface of the body. The ends of the body terminate the channel and serve as end wall for the channels. A portion of the channel passes through the end walls providing a first and a second opening to accept wires to be spliced.

A flat, conductive interconnection bar extending substantially the width and length of the exposed portion of the channel in the upper surface of the body is oriented horizontally providing for reference purposes an upper and lower side. The bar is positioned in the upper portion of the channel over the wires with the underside of the bar facing downward into the channel. A plurality of conductive prongs which are electrically and mechanically connected to the bar project downward from the lower side of the bar. These prongs include tips for piercing the insulation of the wires in the channel beneath the prongs to make connection between the first wire and second wire by way of the bar.

An insulating cover for the body, which encompasses the body and extends over the exposed portion of the channel on the upper surface of the body, insulates the interconnection bar and secure it in place in the channel. The cover is slideably positioned about the body by movement in the direction of the longitudinal axis.

In one alternative embodiment of the present invention, the prongs are formed with an inverted "V" cut to accept various sized wire. The wires are urged into the "V" cut by means of resilient material located in the lower portion of the channel. This embodiment permits the acceptance of a variety of wire sizes placed into the channel through the same opening, a necessary feature for a low profile, in-line splice.

DETAILED DESCRIPTION OF THE INVENTION

Figure 1A:
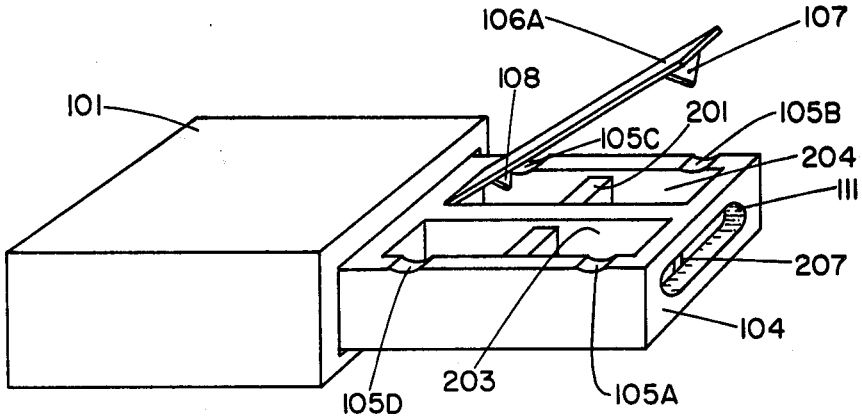
FIG. 1A is a perspective view of the present invention.

FIG. 1A is a perspective view of the invention illustrating its basic components which include a body 104, an interconnection bar 106A, and a cover 101. In this Figure, the device is shown in its open position with the cover removed to the left of the body. It should be noted however that the cover may be removed to either side of the body. In normal use, wires are inserted in openings, such as opening 111, found in either end of the body. After passing through the openings, the wires are guided into channels within the body, such as channels 203 and 204 where the wires are spliced together by means of the interconnection bars, such as bar 106A. These bars have sharp prongs on their lower sides, such as prong 107 and 108, which are passed downward on to the wires causing the prongs to penetrate the insulation of the wires to make contact directly with the conductors beneath the insulation. The interconnection bars are designed to fit within the upper portion of the channel so that the cover may be returned to its position about the body. The body and cover are formed of insulating material to protect the user by providing a completely insulated package when the cover is returned to the closed position.

Figure 1B:
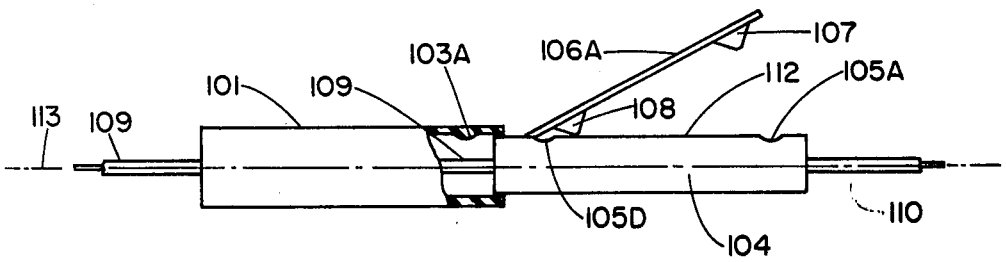
FIG. 1B is a side elevation view of the present invention, showing the cover in the open position.

FIGS. 1B through 6 show various features of the invention in greater detail. For example, FIG. 1B is a side elevation view of the invention with the cover placed in the open position. This Figure shows a projection 103A extending downward from the under side of the cover's upper wall. As can be seen in the cross sectional view of FIG. 6, the cover is comprised of four walls, 602 through 605. The upper wall 602 includes a second projection 103B that is similar to projection 103A in that it extends downward from the underside of the upper wall; however, it is located on the opposite side of an opening 601 which passes through the cover. There are a total of four such projections however two are not shown. These projections are symmetrically positioned on the underside of wall 602 to mate with four depressions 105A through 105D located on the upper surface of the body and shown in FIG. 2 in plan view. The position of two of the depressions is also shown in the side view of FIG. 1B. The projections and depressions form a detent system to secure the cover to the body when the cover is placed in the closed position.

The cover is formed of resilient material and the opening 601, which extends longitudinally (parallel to longitudinal axis 113 shown in FIGS. 1B and 2) through the cover to accept the body, is designed to provide a slight force fit about the body due to the presence of the four projections within the opening 601. As the cover is moved to the closed position about the body, the cover expands slightly to accept the force fit; however, once the projections are in place above the depressions, they are forced into the depressions by the resiliency of the cover to secure the cover in place against inadvertent opening.

Figure 4:
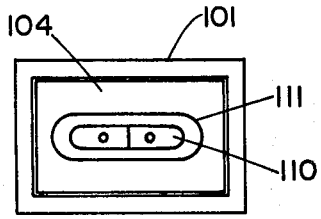
FIG. 4 is an end elevation view of the device shown in FIG. 1B.
Figure 5:
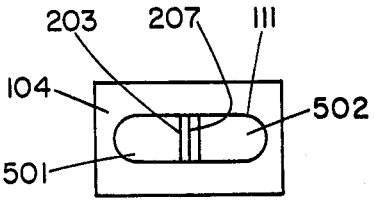
FIG. 5 is an end view of the body of the device shown in FIG. 1B without wires and illustrates a sharp tip used to divide cables.
Figure 6:
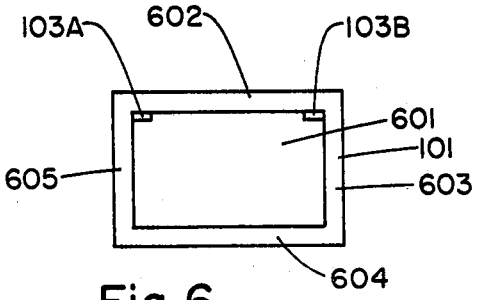
FIG. 6 is an end view of the cover of the device shown in FIG. 1B illustrating projections used for locking the device.

FIG. 1B shows a first wire 109 entering the left end of the body and a second wire 110 entering the right end of the body. The right end opening 111 for the second wire is shown in FIGS. 1A, 4 and 5. FIG. 1A shows a perspective view of the opening while FIG. 4 shows an end elevation view in which a two wire cable 110 is shown as entering the opening 111. FIG. 5 is an end elevation view identical to FIG. 4 with the exception that no cable is shown entering the opening. It can be seen in FIG. 5 that once a wire is placed in the opening 111 it meets a dividing wall 203 that separates the opening into two portions 501 and 502. The dividing wall 203 has a tapered end facing the opening which has a sharp tip 207 useful in dividing two wire cables, such as commonly used zip cord.

After passing through the opening, the individual wires of the divided two wire cable are each guided into one of the two channels 203 and 204 which run parallel to the longitudinal axis 113 of the body 104. The position of the wires in the channels is partially shown in FIG. 2. One of the wires 110A of the two wire cable 110 is shown in the right-hand portion of the channel 204 while one of the wires 109A of the two wire cable 109 is shown in the left-hand portion of the channel 204. A barricade wall 201 divides the channel into two equal portions to aid the user in knowing when sufficient wire has been inserted through the end wall openings (such as opening 111) into the channels.

Figure 2:
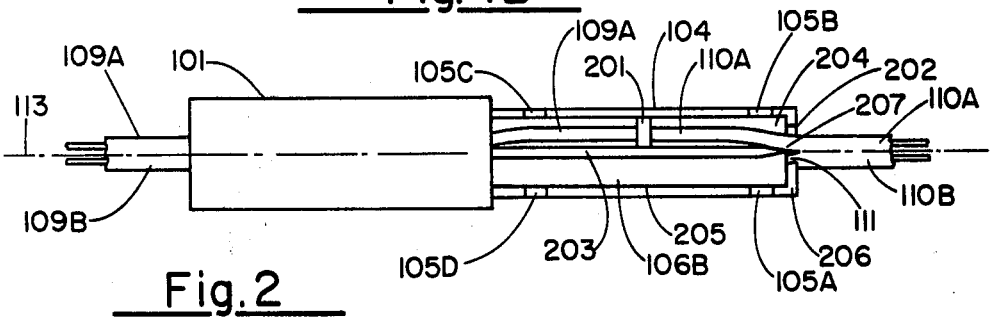
FIG. 2 is a plan view of the device shown in FIG. 1B.
Figure 3:
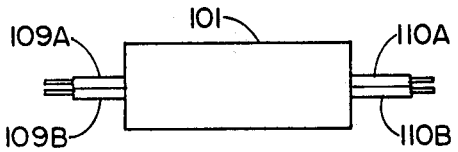
FIG. 3 is a plan view of the device shown in FIG. 1B with a cover in the closed position about the body.

The interconnection bar is then pressed down on the wires to interconnect them. The position of the interconnection bar after this operation has been accomplished is shown in FIG. 2. Interconnection bar 106B is shown pressed into place in the top of the channel 203 over wires 109B and 110B. FIG. 1A shows the barricade wall 201 as being lower than the top of the channel 204 to permit the interconnection bar to lie completely within the channel and thereby permit the cover to be returned over the body once the splice has been made.

It should be noted that the barricade wall can also be set to limit the penetration of the prongs to prevent damage to the bottom wall of the body. It is possible, however, to completely eliminate the barricade wall by making the bottom wall sufficiently thick, or of material which is sufficiently strong, to resist penetration by the prongs. In such a configuration, the length of the wire within the channels can be set by eye.

The construction of the channels in the manner shown has a number of advantages. As noted, the exposed upper portion permits viewing the correct depth of penetration of the wires into the channels and, if necessary, the proper adjustment of their position so that they lie in the bottom of the channel in a location to accept the prongs. The exposed upper portion of the channels also permits the interconnection bars to be manually minipulated to insure that the prongs penetrate the insulation about the wires and thereby insure good contact with the conductors. The channels do not extend completely through the end walls of the body. There are only openings through the end walls to the channels. A wire is required to pass through the opening in the end walls, which is relatively small compared to the channel size, to aid in capturing the wire within the body and aid in making a secure splice. The relatively small size of the openings in the end walls aids in insulating the splice by preventing user contact with the interconnection bars.

The longitudinal position of the channels within the body allows fabrication of a low profile, in-line splice. The wires are dressed to run "in-line" internally with the external direction of the wires and the walls of the body are made relatively thin so that the splice can be made to take up little more cross sectional area than the wires themselves. The Figures show a substantially larger cross section than is structurally necessary. The larger cross section is used in the Figures only to clearly illustrate the details of the device. Actual devices are usually fabricated with appreciably smaller cross sections. As a result, practical devices fabricated in accordance with the present invention not only extend in the same direction as the wires, but also fit within the space allocated for such wires in conduits or other similar confined spaces. In addition, the devices are generally colored to match the color of the wires for external wiring, making them virtually unnoticeable.

Figure 7:
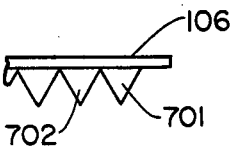
FIG. 7 is a side view of an interconnection bar with a plurality of prongs.

The two prongs 107 and 108 on interconnection bar 106A are placed as shown primarily for illustrative purposes. A plurality of prongs, arranged in series as illustrated by prongs 701 and 702 in FIG. 7 is more usual. The plurality of prongs provides a greater assurance of contact and a better means of securing the wires to the interconnection bars which, in addition to insuring a good electrical connection, also serve to better retain the wires within the body. The interconnection bars are themselves captured within the channels and maintained there by the cover which prevents their removal, once the cover has been placed over the bars in the closed position.

Figure 8:
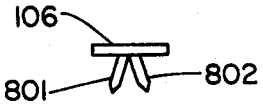
FIG. 8 is an end view of an interconnection bar with skewed prongs used to engage solid wire.

The prongs may take a number of forms for different purposes. A simple sawtooth arrangement as shown in FIG. 7 is satisfactory for standard wire. The prongs merely penetrate through the insulation to the wire strands making contact and securing the wire at the same time. For solid wire, a different approach is usually required. FIG. 8 is a side elevation view of an interconnection bar showing skewed prongs 801 and 802. This arrangement permits the prong to cut through the insulation without being blocked by the solid conductor. As the prongs penetrate through the insulation and make contact with the conductor, they tend to dig into the conductor to make good contact, but the conductor does not prevent them from continuing their downward motion because the prongs are spread apart as necessary to accept the conductor between them. This feature not only permits the acceptance of solid conductor wires, but also permits the acceptance of a variety of wire sizes. There is no need for different openings or blocked shaped bodies to accept the different wire size. The skewed prong arrangement can also be used with standard wire.

Another prong configuration designed to accept various wire sizes is illustrated in FIGS. 9 through 12. Basically the prong is formed of a sheet which contains an inverted "V" cut. The wire is forced up into the inverted "V" cut by resilient material located in the base of the channel. The wire rises upward to the point where the insulation has been cut through and the conductors within the wires are wedged between the sides of the inverted "V" cuts. Different wire sizes will rise to whatever level is required to permit the conductors to make contact with the sides of the inverted "V" cut.

Figure 9C:
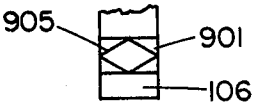
FIG. 9C is a bottom view of the device of FIG. 9B.
Figure 9A:
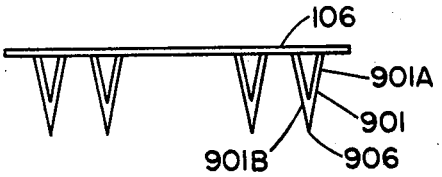
FIG. 9A is a side elevation view of an interconnection bar with upright "V" shaped prongs.
Figure 9B:
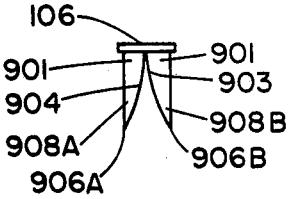
FIG. 9B is an end elevation view of the device of FIG. 9A having an inverted "V" cut to accept various wire sizes.

FIG. 9B is an end view of an interconnection bar 106 and a prong 901 containing an inverted "V" cut 904, which divides the prong into two halves 908A and 909B. The inverted "V" cut extends from the tips 906A and 906B of the two halves to their junction 903.

Figure 10A:
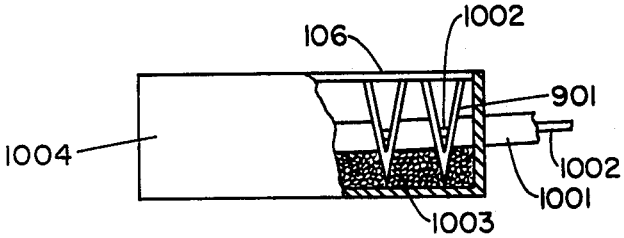
FIG. 10A is a side elevation view of the body broken away to show the interconnection bar of FIG. 9A as used in the body to form a complete splice.
Figure 10B:
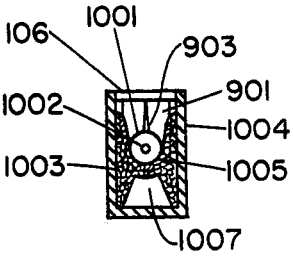
FIG. 10B is an end elevation view of the device shown in FIG. 10A with the body broken away to show the use of the prong shown in FIG. 9B.
Figure 11:
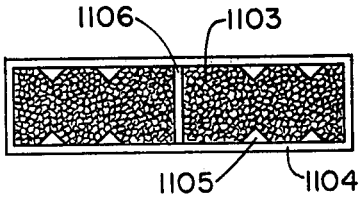
FIG. 11 is a plan view of the body shown in FIG. 10A with the cover, interconnection bar, and wire removed to illustrate openings in the resilient material to facilitate the insertion of the prongs shown in FIG. 9B.

FIG. 10B is an end view of a channel with the body broken away to permit viewing the use of the type of prong shown in FIG. 9B in making contact with and securing a wire within the channel. In this Figure, an interconnection bar 106 supporting a prong 901 is pressed into a channel 1005 in a body 1004. The base of the channel is filled with a resilient material 1003, such as synthetic rubber foam. A wire 1001 having a central conductor 1002 rests on the foam. The wire is shown in its position in the inverted "V" cut after its conductor has risen to where it is wedged between the edges of the cut. These edges are sharpened to aid in cutting through the insulation, but are not sufficiently sharp to cut into the wire appreciably. To assist in urging the wire upward, a support platform 1007 having a cross section to conform to the inverted "V" cut (but truncated to provide space for the wire and foam), is inserted beneath the foam. The support platform is particularly useful where the size of the wire will result in the wire being positioned high in the cut where the force of the foam is relatively weak. The platform confines the foam to a smaller volume and thereby increases the force applied to the wire.

Figure 12:
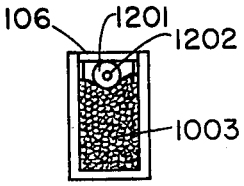
FIG. 12 is an end elevation of the invention similar to that of FIG. 10B with the exception that a smaller diameter wire is used to show its position of contact for comparison purposes.

FIG. 12 shows a cross section similar to that of FIG. 10B with the exception that a smaller size wire 1201 with a correspondingly smaller size conductor 1202 is used. As can be seen, the smaller wire is still accommodated, however, contact is made near the top of the inverted "V" cut. This arrangement provides for a wide variety of wire sizes without requiring separate openings for each size, nor a block shaped body which would preclude a low profile, in-line configuration.

Since a sheet type prong is used it may easily be fabricated in a form which will provide additional strength as well as aid in cutting through the insulation to make better contact to the conductors. This configuration is shown in FIGS. 9A, 9C and 10A. As shown in FIG. 9A, the prong is made of a sheet which is folded to form an upright "V" cross section. In this Figure, one leg of the upright "V" prong 901 is designated 901A, while the other is designated 901B. This structure adds strength to the prongs by preventing it from being bent as it is forced down over a wire. It is possible to place an inverted "V" cut in this type of prong as shown in the end elevation view shown in FIG. 9B and in the bottom view of FIG. 9C.

FIG. 10A shows a splice made with the upright "V" structure having an inverted "V" cut. The interconnection bar 106 is in position in a body 1004 which is broken away to show the connection between the wire 1001 and prong 901. As the foam 1003 urges the wire 1001 upward into the inverted "V" cut, the two legs of each prong, 901A and 901B, cut through the insulation and tend to strip the wire bare to the conductor between the legs to aid in insuring good contact between the prong and conductor. The bare conductor 1002 is shown between the legs 901A and 901B in FIG. 10A. Although complete stripping does not always occur, the tendency to accomplish this significantly aids in making good contact.

The upright "V" structure has a tendency to depress the foam more than a simple sawtooth type of prong arrangement and therefore reduces the force on the wire provided by the foam. To overcome this, the foam is preformed with holes along the outer edges of the foam, designed to accept the prongs as illustrated by hole 1105 shown in FIG. 11.

Although all the illustrations show a rectangular cross section, a rounded body can be substituted for special applications where this type of cross section would be more desirable.

Another embodiment, which remains within the scope of the invention, includes a multiplicity of channels to accommodate a number of wires. The wires may be accepted through a single opening at each end or through a plurality of openings.

Finally, channels may be arranged to be exposed on any outside surface including the bottom as well as the top. The same channel may be exposed on the top and bottom surface and the interconnection bars may be inserted on the top and bottom to make redunant interconnections to improve reliability.

The specific embodiments described herein and the alternative configurations are presented by way of illustration only and are not intended to be limiting.

Having described my invention, I claim:

1. Apparatus for providing a rapid, secure and insulated electrical splice of the type in which a first and a second wire are electrically connected by solderless means, comprising:

(a) a body of insulating material, having a reference longitudinal axis and upper surface, the body also having a channel which passes through it in a direction substantially parallel to the longitudinal axis, the channel being exposed along the upper surface of the body, but not at the channel ends, the ends of the channel are exposed on surfaces other than the upper surface of the body by a first and a second opening designed to accept the first and second wires respectively into the lower portion of the channel away from the upper surface of the body, (b) a generally flat, conductive interconnection bar extending substantially the width and length of the exposed portion of the channel in the upper surface of the body and oriented horizontally to present an upper and lower side, the bar being located in the upper portion of the channel with the underside of the bar facing downward into the channel, the bar having a first end adjacent the first opening and a second end adjacent the second opening, (c) a first conductive prong, connected to and projecting downward from the lower side of the interconnection bar adjacent the first end, the tip of the first prong piercing the insulation of the first wire to make connection between the first wire and the bar and to secure the first wire within the channel, (d) a second conductive prong connected to and projecting downward from the lower side of the interconnection bar adjacent the second end, the tip of the second prong piercing the insulation of the second wire to make connection between the second wire and the bar and thus to the first wire through the interconnecting bar, (e) an insulating cover for the body which encompasses the body and extends over the exposed portion of the channel on the upper surface of the body to insulate the interconnection bar and secure it in place in the channel, the cover being slideably positioned about and off the body by movement generally in the direction of the longitudinal axis of the body, (f) wherein said first and second prongs are formed of flat sheets oriented generally orthogonal to the reference longitudinal axis and each of said flat sheets contain an inverted "V" cut, forming a prong with two tips, the inside edges of the inverted "V" cut being sharp to pierce insulation and the inverted "V" cut accepting various wire sizes at the level in the "V" cut having a spacing between the inside "V" cut edges which corresponds to a particular wire diameter selected for connection and (g) wherein said apparatus further comprises resilient material located in the lower portion of the channel to urge a wire inserted in the channel upwards into the inverted "V" cut to pierce the insulation with the "V" cut inside edges and to make connection with the prong.

2. Apparatus as claimed in claim 1, wherein the resilient material includes openings to accept the prong tips and thereby reduce the pressure required to insert the interconnection bar in the channel and increase the urging force of the resiient material against the wire inserted in the channel.

3. Apparatus as claimed in claims 2, further comprising a projection of the body extending upward and inwardly from the lower surface of the channel and having essentially a truncated inverted "V" shaped, positioned to mate with the inverted "V" cut of the prong in order to support a wire inserted in the channel at the level required to pierce the insulation and make electrical contact between the wire and the prong.

4. Apparatus for providing a rapid, secure and insulated electrical splice of the type in which a first and a second wire are electrically connected by solderless means, comprising:

(a) a body of insulating material, having a reference longitudinal axis and upper surface, the body also having a channel which passes through it in a direction substantially parallel to the longitudinal axis, the channel being exposed along the upper surface of the body, but not at the channel ends, the ends of the channel are exposed on surfaces other than the upper surface of the body by a first and a second opening designed to accept the first and second wires respectively into the lower portion of the channel away from the upper surface of the body, (b) a generally flat, conductive interconnection bar extending substantially the width and length of the exposed portion of the channel in the upper surface of the body and oriented horizontally to present an upper and lower side, the bar being located in the upper portion of the channel with the underside of the bar facing downward into the channel, the bar having a first end adjacent the first opening and a second end adjacent the second opening, (c) a first conductive prong, connected to and projecting downward from the lower side of the interconnection bar adjacent the first end, and tip of the first prong piercing the insulation of the first wire to make connection between the first wire and the bar and to secure the first wire within the channel, (d) a second conductive prong connected to and projecting downward from the lower side of the interconnection bar adjacent the second end, the tip of the second prong piercing the insulation of the second wire to make connection between the second wire and the bar and thus to the first wire through the interconnecting bar, (e) an insulating cover for the body which encompasses the body and extends over the exposed portion of the channel on the upper surface of the body to insulate the interconnection bar and secure it in place in the channel, the cover being slideably positioned about and off the body by movement generally in the direction of the longitudinal axis of the body (f) wherein said first and second prongs are formed of flat sheets oriented generally orthogonal to the reference longitudinal axis and each of said flat sheets contain an inverted "V" cut, forming a prong with two tips, the inside edges of the inverted "V" cut being sharp to pierce insulation and the inverted "V" cut accepting various wire sizes at the level in the "V" cut having a spacing between the inside "V" cut edges which corresponds to a particular wire diameter selected for connection, and (g) wherein the prongs are formed of a sheet folded to have an upright "V" shaped cross section when viewed in a vertical plane parallel to the longitudinal axis of the body, the upright "V" shaped cross section serving to strengthen the prong and aid in stripping the insulation from the wire.

* * * * *